United States Patent [19]

Muller et al.

[11] 4,175,232

[45] Nov. 20, 1979

[54] INOGRAPHY IMAGING METHOD AND CHAMBER

[75] Inventors: Jürgen Müller; Manfred Schmidt; Rolf Eickel, all of Munich, Fed. Rep. of Germany

[73] Assignee: AGFA-Gevaert, A.G., Leverkusen, Fed. Rep. of Germany

[21] Appl. No.: 829,960

[22] Filed: Sep. 1, 1977

[30] Foreign Application Priority Data

Sep. 2, 1976 [DE] Fed. Rep. of Germany ..... 2639444
Jan. 13, 1977 [DE] Fed. Rep. of Germany ..... 2701202

[51] Int. Cl.[2] ..... B41M 5/00
[52] U.S. Cl. ..... 250/315.2; 250/315.1
[58] Field of Search ..... 250/315 R, 315 A

[56] References Cited

U.S. PATENT DOCUMENTS

| | | | |
|---|---|---|---|
| 3,828,192 | 8/1974 | Morsell | 250/315 A |
| 4,065,670 | 12/1977 | Morsell | 250/315 A |
| 4,074,133 | 2/1978 | Muller | 250/315 A |

*Primary Examiner*—Craig E. Church
*Attorney, Agent, or Firm*—Peter K. Kontler

[57] ABSTRACT

An ionography imaging chamber wherein the sections of the pressure vessel carry concentric spherical electrodes centered at the source of X-rays and defining a spherical interelectrode gap. A dielectric receptor sheet is converted into a portion of a hollow cylinder during introduction into the gap and its marginal portions are thereupon biased against one of the sections by an inflatable gasket which seals the gap from the surrounding atmosphere prior to admission of compressed high Z gas. The admitted gas deforms the sheet against the electrode which is nearer to the source of X-rays while the gas at the rear side of the sheet is allowed to escape by way of ports in the respective section. If the gap receives two sheets at a time, the admission of high Z gas takes place between the sheets so that each sheet overlies and closely follows the outline of the corresponding electrode. The two sheets may constitute discrete sheets or overlapping portions of a single sheet which is trained over a roller at a locus remote from the point of introduction of the sheet into the pressure vessel. Simultaneous exposure of both sheets to object-modulated X-rays results in the making of positive and negative latent images of the object.

32 Claims, 5 Drawing Figures

1
1a
2
2a
2b
3
4
5
6
7
8
9
10
11
12
13
14
15'
15''
16
17
17a
d

INOGRAPHY IMAGING METHOD AND CHAMBER

BACKGROUND OF THE INVENTION

The present invention relates to ionography imaging methods and apparatus. More particularly, the invention relates to improvements in ionography imaging techniques which can be carried out by resorting to chambers of the type wherein an elastic dielectric receptor sheet or an analogous insulating charge-receiving medium is placed into an interelectrode gap which is defined by an anode and a cathode and contains a high Z gas. Still more particularly, the invention relates to improvements in ionography imaging chambers of the type wherein the electrodes which define the gap are portions of concentric spheres centered at the X-ray source, and to improvements in a method of making X-ray images by resorting to such chambers.

In imaging systems of the above outlined character, the high Z gas is maintained at an elevated pressure. The gas absorbs X-rays and effects the generation of a charge by a quantum process, such as the photoelectric or Compton effect. The primary and secondary electrons travel between the electrodes along field lines toward one side of the dielectric receptor sheet while the other side of the sheet abuts against one of the electrodes. The electrons produce a latent electrostatic image which is made visible by an electrostatic technique including the deposition of toner particles or in any other suitable way.

A method which can be practiced by resorting to spherical electrodes is disclosed in U.S. Pat. No. 3,803,411 granted Apr. 9, 1974 to Karl-Hans Reiss. The high Z gas (e.g., iodine-methane or a noble gas, such as Xenon or Krypton) is maintained at a pressure which exceeds atmospheric pressure, for example, at a pressure of at least six atmospheres. Since the object (especially a patient) must be protected from exposure to excessive doses of X-rays, the pressure of high Z gas (which absorbs X-rays) is preferably as high as possible. However, the pressure of high Z gas cannot be increased at will primarily for technical reasons and especially if the interelectrode gap must be accessible for removal of the dielectric receptor sheet after each exposure. Therefore, it is desirable to employ a relatively wide interelectrode gap (the width of the gap also influences the magnitude of X-ray charge to which the object must be exposed in order to obtain a satisfactory latent image). As a rule, the width of the gap is not less than 8–10 millimeters; this insures the achievement of a satisfactory yield.

However, if the width of the gap is not less than 8–10 millimeters, the latent image which is obtained by resorting to known ionography imaging chambers is unsharp, especially in the absence of correspondence or alinement between the electric field lines in the gap and the paths of X-rays from the source to the imaging chamber, i.e., if the electrodes which define the gap are not portions of concentric spheres which are centered at the X-ray source. Presently known ionography imaging chambers which employ spherical electrodes exhibit several serious drawbacks, especially in connection with the insertion and removal of dielectric receptor sheets. As a rule, the sheets are inserted by hand which is a tedious and time-consuming procedure. The dielectric receptor sheet in the gap between the electrodes must be deformed so as to follow the curvature of one of the electrodes. Such sheet is normally subjected to elastic deformation; therefore, it is preferably an extremely thin and highly elastic foil which can readily undergo elastic deformation to a degree that is needed to convert a flat sheet into a concavo-convex body. Nevertheless, only the circular central portion of the inserted and deformed sheet receives a latent image which is substantially free of distortion. Distortion of the image increases in a direction from the common center toward the edges of the electrodes and is invariably very pronounced if the receptor is a polygonal sheet, normally a square or rectangular foil. Pronounced distortion of latent images along the edges and especially at the corners of a rectangular or square sheet is attributed to lack of uniformity of distribution of stresses along the edges; the non-uniformly distributed stresses are propagated toward the common center of the electrodes when the sheet is inserted into the gap and is deformed to follow the curvature of one of the electrodes. Upon removal of the sheet from the interelectrode gap, the stresses diasppear but the latent image is distorted all the way around the center and especially at the corners.

OBJECTS AND SUMMARY OF THE INVENTION

An object of the invention is to provide a novel and improved method of reducing the extent of distortion of object-modulated latent X-ray images on polygonal dielectric carrier sheets in an ionography imaging chamber having concentric spherical electrodes.

Another object of the invention is to provide a novel and improved method of deforming polygonal elastic dielectric receptor sheets preparatory to exposure of such sheets to object-modulated X-rays.

An additional object of the invention is to provide a novel and improved method of converting a flat rectangular or square dielectric receptor sheet into a concavo-convex body.

A further object of the invention is to reduce the area of deformation of latent images on dielectric receptor sheets upon removal of such sheets from an ionography imaging chamber wherein the gap for reception of sheets is defined by spherical electrodes centered at the X-ray source.

Another object of the invention is to provide a novel and improved ionography imaging chamber of the type having concentric spherical electrodes.

One feature of the invention resides in the provision of a method of exposing elastic dielectric receptor sheets in the gap between concentric first and second spherical electrodes of an ionography imaging chamber to object-modulated X-rays which issue from a source located nearer to one of the electrodes. The method comprises the steps of introducing into the gap at least one dielectric receptor sheet, biasing at least a part of the margin of the introduced receptor sheet against the adjacent portion of the chamber, and thereupon admitting into the gap compressed high Z gas at one side of the introduced receptor sheet at a pressure which suffices to deform the sheet in the gap so as to maintain the other side of the sheet in face-to-face contact with the first electrode while the aforementioned part of the margin is biased against and cannot move relative to the chamber. The receptor sheet is preferably converted into a portion of a hollow cylinder not later than in the course of the introducing step. If the sheet is a polygon (e.g., a square or a rectangle), the aforementioned part of the margin preferably includes two spaced-apart parallel portions of the margin.

The biasing step preferably includes clamping the part of the margin of the sheet in the gap between the aforementioned portion of the imaging chamber and an inflatable gasket or a non-inflatable gasket which is biased by an inflatable gasket. The inflatable gasket seals the gap from the surrounding atmosphere prior to admission of compressed high Z gas and also while the sheet in the gap is exposed to object-modulated X-rays.

The first electrode is preferably the one electrode, i.e., that electrode which is nearer to the source of X-rays.

The method preferably comprises the additional step of providing a path for the escape of gases from between the other side of the sheet in the gap and the first electrode during admission of compressed high Z gas; this insures that the other side of the sheet can be deformed into full face-to-face contact with the first electrode.

The introducing step may include introducing into the gap two dielectric receptor sheets, and the step of admitting high Z gas then comprises admitting compressed high Z gas between the sheets in the gap so that one of the sheets is deformed against the first and the other sheet is deformed against the second electrode. The just discussed modified method preferably further comprises the step of providing paths for evacuation of gases from between the one sheet and the first electrode as well as from between the other sheet and the second electrode during admission of compressed high Z gas between the sheets in the interelectrode gap.

The sheets may constitute overlapping portions of a single larger sheet, or two discrete sheets.

The pressure of high Z gas in the interelectrode gap is preferably in the range of several atmospheres above atmospheric pressure.

The novel features which are considered as characteristic of the invention are set forth in particular in the appended claims. The improved imaging chamber itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
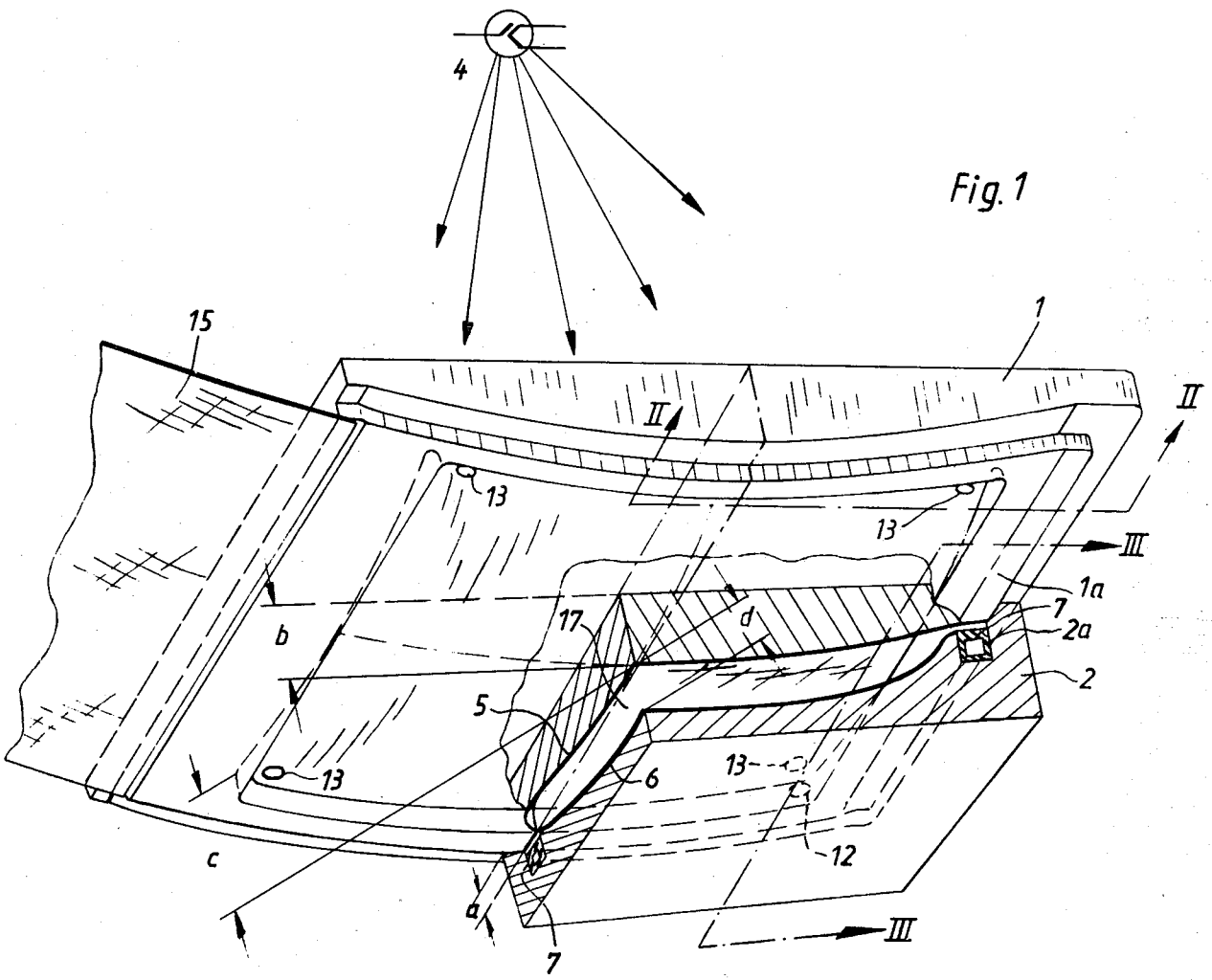
FIG. 1 is a fragmentary perspective view of an ionography imaging chamber which embodies one form of the invention.
Figure 2:
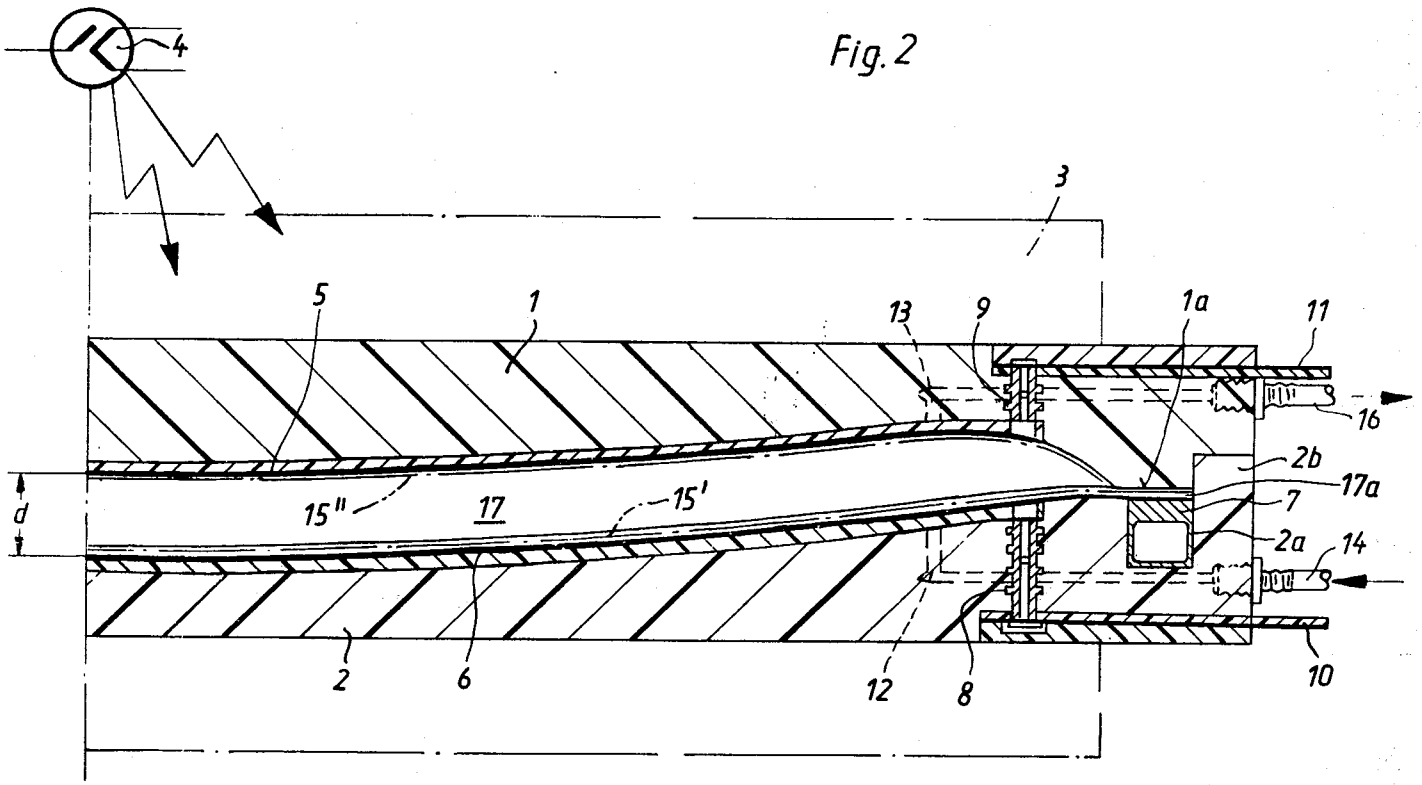
FIG. 2 is an enlarged fragmentary sectional view as seen in the direction of arrows from the line II—II of FIG. 1.
Figure 3:
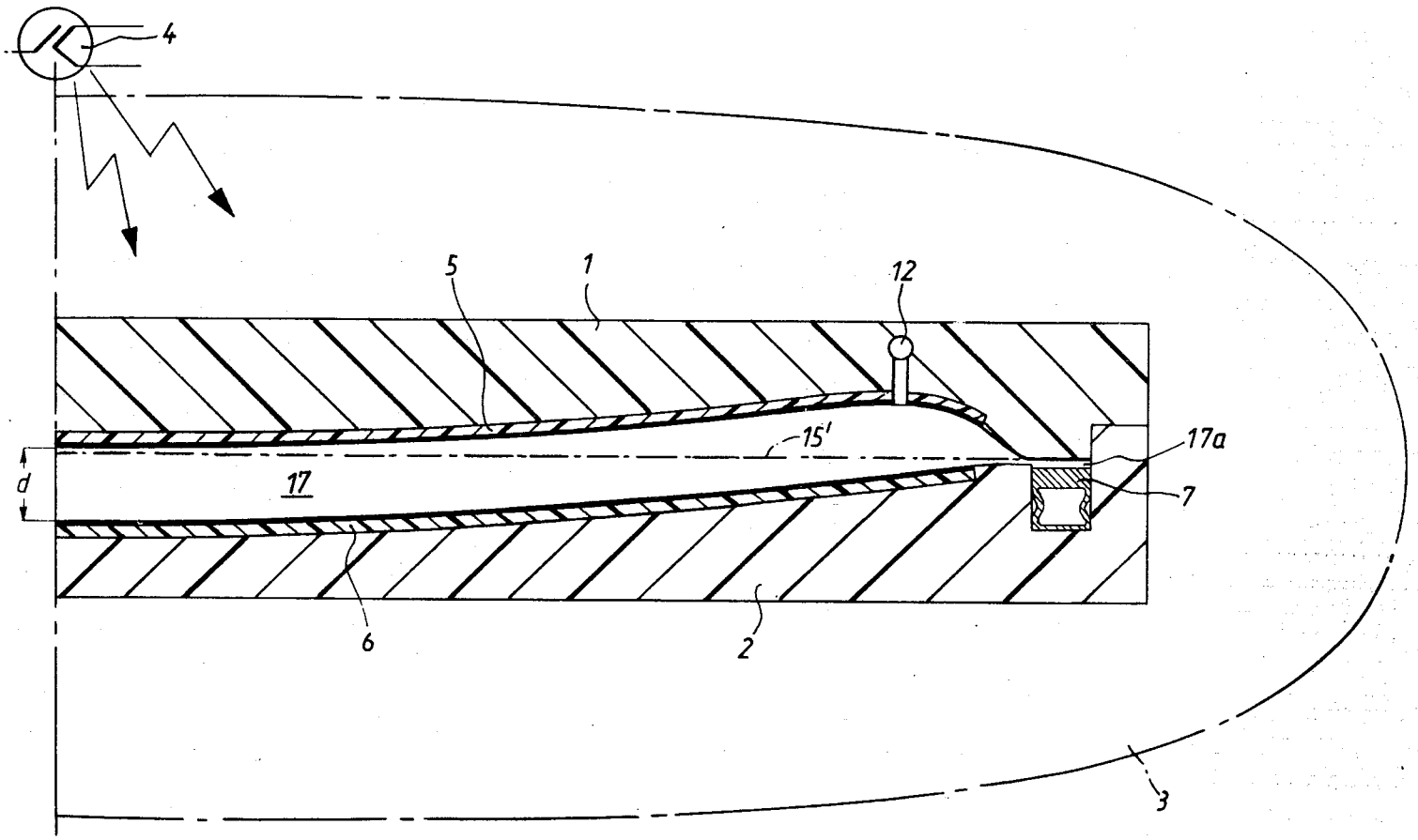
FIG. 3 is an enlarged fragmentary sectional view as seen in the direction of arrows from the line III—III of FIG. 1.

Referring first to FIGS. 1 to 3, there is shown a portion of an ionography imaging chamber including a pressure vessel having sections or halves 1 and 2, and a jacket 3 (indicated by phantom lines) of the type disclosed in commonly owned U.S. Pat. No. 4,021,668 granted May 3, 1977 to Pfeifer et al. The purpose of the jacket 3 is to enable the pressure vessel to withstand stresses which develop when the interelectrode gap 17 is filled with a highly compressed high Z gas, such as Xenon. The source of X-rays is shown at 4. The centers of curvature of the spherical inner sides or surfaces of the sections or halves 1 and 2 of the pressure vessel are located at the center of the source 4.

The interelectrode gap 17 is surrounded by an inflatable flexible sealing element or gasket 7. When the gasket 7 is inflated, it completely seals the interelectrode gap 17 from the surrounding atmosphere to thus prevent escape of compressed high Z gas through the clearances between the adjoining portions of the sections 1 and 2. The section 2 has a circumferentially complete groove 2*a* for the gasket 7. The latter is preferably of the type disclosed in the commonly owned copending patent application Ser. No. 768,539 filed Feb. 14, 1977 by Thate et al. for "Sealing device".

The spherical (convex) inner side of the section 1 is overlapped by and adheres to a metallic electrode 5. A second metallic electrode 6 coats the spherical (concave) inner side of the section 2. The gap 17 is located between the electrodes 5 and 6 which are centered at the source 4 of X-rays. The electrode 5 is connected to an external voltage source (not shown) by a rivet 9 and conductor means 11. The means for connecting the electrode 6 with the external energy source comprises a rivet 8 and conductor means 10. The construction of electrodes 5, 6 and the mode of connecting them with an external potential are disclosed in the aforementioned commonly owned U.S. Pat. No. 4,021,668. The section 2 has four gas-admitting ports 12 which are disposed at the four corners of the square or rectangular gap 17; these ports communicate with a nipple 14 which is connected to a source 27 (see FIG. 4) of high Z gas (e.g., Xenon, Krypton or Freon). The section 1 has four gas-evacuating ports 13 each of which is located opposite one of the ports 12. The ports 13 communicate with a nipple 16 which is connected with the source 27 in a manner to be described with reference to FIG. 4.

The section 1 has a frame-like projecting portion or rib 1*a* which is located opposite the groove 2*a*, and the section 2 has a frame-like projecting portion or rib 2*b* which surrounds the rib 1*a*. The height of the ribs 1*a*, 2*b* determines the width of the interelectrode gap 17. When the gasket 7 is not inflated, it is out of contact with the adjacent face of the rib 1*a* so that the parts 1*a* and 7 define a relatively narrow clearance 17*a* which communicates with and surrounds the interelectrode gap 17. The clearance 17*a* consists of four elongated portions, and one of these portions (namely, the portion 17*a*) serves as a passage for admission of elastic dielectric receptor sheets 15 into and for withdrawal of sheets 15 from the gap 17. Two portions of the clearance 17*a* are curved and such portions are disposed opposite each other and extend between the other two portions of the clearance. The curved portions of the clearance 17*a* are centered at the source 4.

Figure 4:
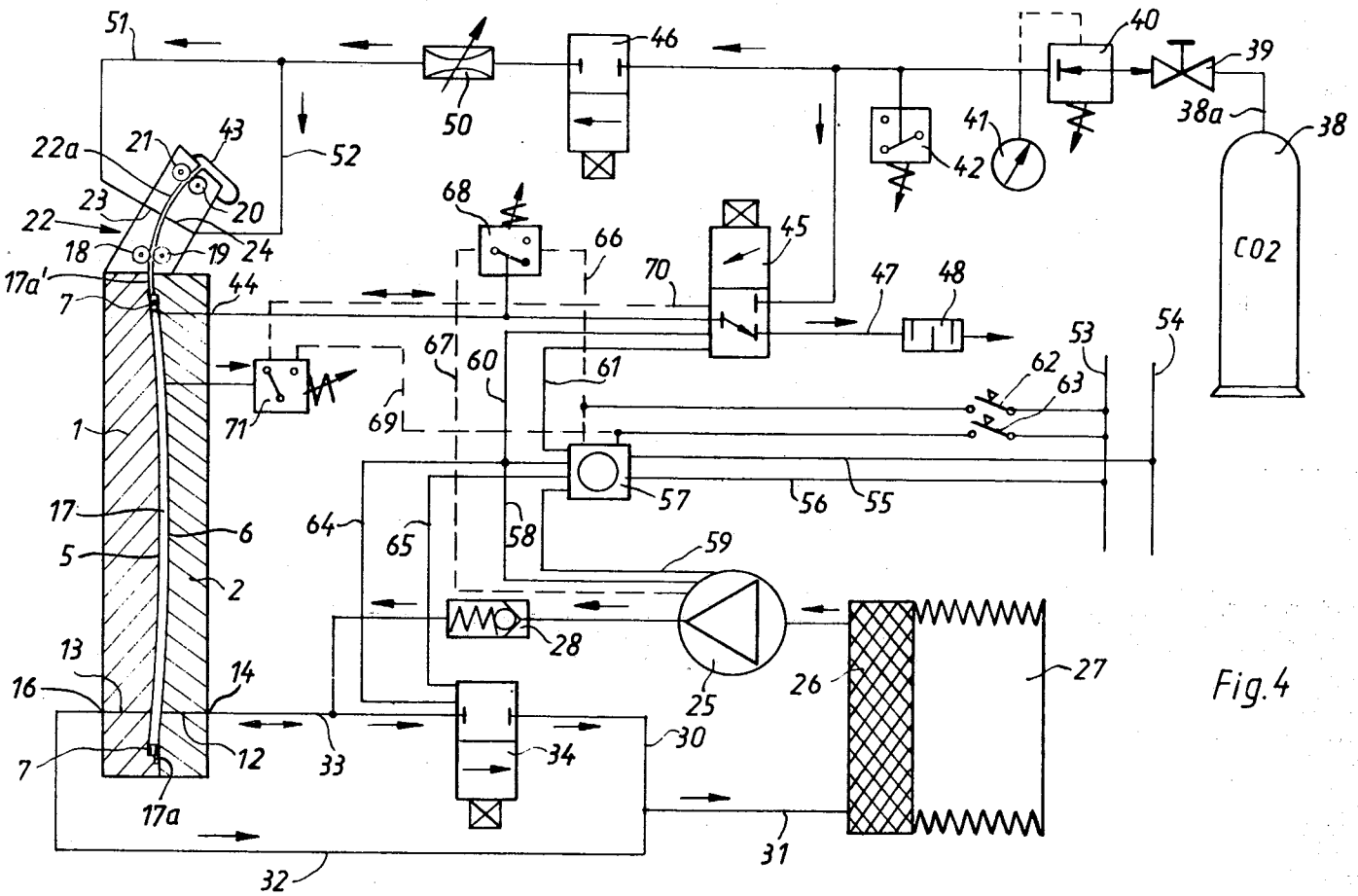
FIG. 4 is a smaller-scale sectional view of the imaging chamber, similar to that of FIG. 2, and a diagrammatic view of the system which supplies compressed high Z gas to the interelectrode gap and a suitable buffer gas to the sealing means for the gap.

The portion 17a' of the clearance 17a communicates with an arcuate channel 22a which is defined by a gate 22 and contains two pairs of advancing rolls 8, 19 and 20, 21 (see FIG. 4). A suitable gate is disclosed in the commonly owned copending patent application Ser. No. 720,577 filed Sept. 7, 1976 by Muller et al. The gate 22 is provided with nipples 23, 24 for admission of a suitable buffer gas (e.g., CO2 gas) which is readily separable from the high Z gas. The purpose of the buffer gas is to prevent escape of expensive high Z gas during introduction of sheets 15 into and during withdrawal of sheets 15 from the interelectrode gap 17. Furthermore, the buffer gas prevents mixing of high Z gas with atmospheric air. When a sheet 15 is properly inserted into the pressure vessel including the sections 1 and 2, the outer end of the channel 22a is sealed by a pivotable flap 43 or by an analogous sealing device.

The electrodes 5 and 6 have a rectangular shape. The width of the gap 17 (i.e., the distance between the electrodes 5 and 6) is shown at d. The extent of deformation of a properly introduced sheet 15 (to a spherical shape) along the longer sides of the electrodes 5 and 6 is shown at a, the extent of deformation of a properly introduced sheet 15 (to a spherical shape) along the shorter sides of the electrodes 5 and 6 is shown at b, and the maximum extent of deformation of a properly introduced sheet 15 (to a spherical shape) along a diagonal of the gap 17 is shown at c (always as seen at right angles to the flat outer side of the section 1). The distance c represents the maximum deformation of corner portions of a rectangular dielectric receptor sheet 15 with respect to the originally flat shape of such sheet. A sheet 15 which is introduced into the gap 17 is flat along the shorter sides of the electrodes 5 and 6 but is cylindrically deformed between such shorter sides, i.e., its curvature matches that of the longer sides of the electrodes. During conversion of the inserted (cylindrical) sheet 15' into a portion of a hollow sphere, the longer sides of the sheet 15' are deformed only to the extent corresponding to the distance a. One can readily visualize the configuration of the sheet 15' in FIG. 2 or 3 by taking a flat rectangular paper sheet and folding it so that the sheet resembles a portion of a hollow cylinder whose shorter sides or marginal portions remain straight. In order to cause the elastically deformable sheet 15' to contact the spherical (concave) inner side of the section 2, it is necessary to deform the longer sides of the sheet to an extent corresponding to the distance a which equals the width d. The width d is selected in such a way that the sheet 15 can be introduced into the gap 17 by curving it in a single direction, namely, along the longer sides, as clearly shown in FIG. 1. If one uses a dielectric receptor sheet of average size, and if the distance between the source 4 of X-rays and the pressure vessel is 1,800 millimeters, the distance a can equal d and is 8 mm, the distance b equals 12 mm, and the distance c equals 20 mm. This insures that a sheet 15 need not contact the centers of the electrodes 5 and 6 during introduction into or during withdrawal from the gap 17.

The position of a sheet 15 immediately upon introduction into the gap 17 is shown at 15' (see FIG. 2). The marginal portions of the sheet 15 then extend into the clearance 17a. Once the sheet 15 is properly inserted (i.e. once it assumes the position 15'), the gasket 7 is inflated whereby it bears against the marginal portions of the sheet and urges such marginal portions against the adjacent face of the rib 1a. The gasket 7 thereby seals the gap 17 from the surrounding atmosphere as well as from the channel 22a of the gate 22. This will be readily appreciated since the inflated gasket 7 completely fills the groove 2a and sealingly engages one side of the sheet 15 while urging the other side of the sheet against the rib 1a. The pressure in the interior of the inflated gasket 7 is sufficiently high to insure that the marginal portions of the sheet 15 (in the position 15') are clamped without slippage. Once the pressure in the interior of the gasket 7 has risen to the preselected value, the ports 12 admit compressed high Z gas into the gap 17 (at the underside of the sheet 15, as viewed in FIG. 2) whereby the inflowing high Z gas deforms the central portion of the sheet 15 and urges it against the convex inner side of the section 1, i.e. against the exposed side of the electrode 5. The deformed position of the sheet 15 is shown at 15''. The pressure of high Z gas is at least 6–7 atmospheres which insures a satisfactory yield as well as requisite deformation of the sheet 15. The latter may consist of a synthetic plastic material, e.g. Mylar (trademark) or polyethylene. Such materials can be readily deformed so as to closely hug the outer side of the electrode 5 without any folds, pleats or like unevennesses. The gas which has filled the space between the electrode 5 and sheet 15 prior to deformation of the sheet in response to admission of high Z gas via ports 12 is allowed to escape through the ports 13 of the section 1. The expelled gas is admitted into the source 27 wherein the pressure equals or approximates atmospheric pressure.

FIG. 4 shows the system which regulates the admission and evacuation of high Z gas and a buffer gas. As mentioned before, the source 27 (e.g. a bellows) contains a supply of high Z gas (this gas is assumed to be a noble gas, such as Xenon) which can be conveyed into the interelectrode gap 17 by a pump 25 which discharges compressed gas into a conduit 33 communicating with the nipple 14 and ports 12. A molar sieve 26 is interposed between the outlet of the source 27 and the intake of the pump 25. The purpose of the sieve 26 is to purify the high Z gas, especially to intercept remnants of buffer gas. The bellows-shaped source 27 is readily inflatable and deflatable and is preferably designed and mounted in such a way that it is not subjected to any (or is subjected to negligible) external biasing stresses. Thus, the pressure of high Z gas in the source 27 preferably equals or closely approximates atmospheric pressure. The conduit 33 contains a ball check valve 28 and admits high Z gas (at a pressure of 6–7 atmospheres) into the nipple 14. This conduit is further connected to the inlet port of a solenoid-operated valve 34 the outlet port of which is connected with the inlet of the source 27 by conduits 30 and 31. The inlet of the source 27 receives high Z gas by way of the molar sieve 26 so that the gas is cleaned immediately following withdrawal from as well as immediately preceding readmission into the source 27. The reference character 32 denotes a conduit which connects the nipple 16 (i.e. the evacuating ports 13) with the conduit 31.

The source of buffer gas (CO2 gas) is a commercially available cylindrical bottle 38 which supplies highly compressed buffer gas for admission into the nipples 23, 24 of the gate 22 as well as into the interior of the inflatable gasket 7. The conduit 38a which is connected to the opening at the top of the bottle 38 contains a shutoff valve 39 and a pressure regulating valve 40 which is connected to a pressure gauge 41 and determines the pressure of buffer gas in the downstream portion of the conduit 38a. The valve 40 is adjustable to select and thereupon maintain the pressure of buffer gas at a desired value. It is presently preferred to select the setting of regulating valve 40 in such a way that the pressure of buffer gas in the gasket 7 at least slightly exceeds the pressure of high Z gas in the interelectrode gap 17 to thus insure that the gasket does not collapse when the pressure of high Z gas reaches the maximum selected value. The gasket 7 may constitute a single piece of deformable tubular stock or it may consist of several discrete parts each of which is connected with the conduit 38*a*. Alternatively, the gasket 7 may be of the type disclosed in the aforementioned commonly owned copending patent application Ser. No. 768,539; the gasket which is disclosed in Ser. No. 768,539 is designed in such a way that it does not collapse and that it can properly seal the interelectrode gap from the surrounding atmosphere even if the pressure in its interior is less than the pressure of high Z gas in the interelectrode gap. The regulating valve 40 is then adjusted to supply to the gasket buffer gas at a pressure which is less than the maximum pressure of high Z gas in the gap 17.

A safety device, here shown as a pressure-responsive switch 42, is provided in the conduit 38*a* downstream of the pressure regulating valve 40 to arrest the apparatus when the pressure of buffer gas is too low, e.g. when the supply of buffer gas in the bottle 38 is exhausted or nearly exhausted.

The connection between the conduit 38*a* and the gasket 7 comprises a conduit 44 which contains a solenoid-operated valve 45. The pressure in the gasket 7 equals the pressure in the conduit 38*a* downstream of the regulating valve 40 as long as the valve 45 remains in a first position in which it establishes a path for the flow of buffer gas from the conduit 38*a* into the conduit 44. When the position of valving element in the valve 45 is changed, the latter connects the conduit 44 with a venting conduit 47 which contains a noise reducing device 48 of any suitable known design. Thus, the body of buffer gas which is to be evacuated from the gasket 7 is simply discharged into the surrounding atmosphere.

The conduit 38*a* is further connected to a conduit 51 which communicates with the nipple 23 and has a branch 52 in communication with the nipple 24. The conduit 51 contains a solenoid-operated valve 46 and an adjustable fluid speed regulating device 50 (e.g. an adjustable flow restrictor). The valve 46 is open during insertion or withdrawal of a sheet 15 from the gap 17 so that the gate 22 then prevents escape of high Z gas into the atmosphere via channel 22*a*.

The system of FIG. 4 further comprises an energy source which is connected to the leads 53, 54. These leads are connected with conductors 55, 56 for a sequence controlling means here shown as a timer 57 which opens or completes the circuit of the motor for the pump 25 via conductors 58, 59 and can energize or deenergize the solenoid-operated valve 45 via conductors 60, 61. The timer 57 is set in such a way that the pressure of high Z gas in the gap 17 reaches the preselected value subsequent to completion of inflation of the gasket 7. Since the quantity of buffer gas which is needed to fill the gasket 7 is relatively small, and since the interior of the gasket 7 receives compressed gas directly from the bottle 38, the timer 57 can be set in such a way that the motor for the pump 25 is started prior to movement of valving element in the valve 45 to that position in which the conduit 38*a* communicates with the conduit 44.

The timer 57 is started in response to closing of a master switch 62. A reversing or exposure terminating switch 63 is actuated in order to cause the timer 57 to reset the valve 45 so that the buffer gas can flow from the interior of the gasket 7 into the conduit 47 subsequent to actuation of the valve 34 (via conductor means 64, 65) in a sense to permit the flow of high Z gas from the gap 17 back into the source 27. In other words, deflation of the gasket 7 takes place subsequent to evacuation of high Z gas from the gap 17.

It is equally within the purview of the invention to replace the timer 57 with a sequence controlling means including a set of pressure responsive switches which regulate the operation of the motor for the pump 25 and the actuation of valves 34, 45 in the aforedescribed sequence. The control lines for such pressure responsive switches are indicated in FIG. 4 by broken lines. The lines 66, 67 connect the master switch 62 with a switch 68 which monitors the pressure of buffer gas in the conduit 44 for admission and evacuation of buffer gas from the gasket 7. The pressure-responsive switch 68 is in circuit with the motor for the pump 25. The circuit of the motor for the pump 25 is completed (via switch 68) only when the pressure in the conduit 44 (and hence in the gasket 7) reaches a preselected value which is preferably slightly higher than the rated pressure of high Z gas in the gap 17. The exposure terminating switch 63 is connected with a second pressure-responsive switch 71 via conductor means 69, 70. The switch 71 is in circuit with the valve 45 whose solenoid is energized when the pressure of high Z gas in the gap 17 drops below a predetermined pressure. The valve 45 then allows buffer gas to flow from the interior of the gasket 7 into the venting conduit 47.

Alternatively, the pressure-responsive switches 68, 71 can be used to determine the maximum permissible pressure of buffer gas in the gasket 7 and the maximum permissible pressure in the interelectrode gap 17, or to insure that the source 4 begins to emit X-rays only when the gasket 7 is adequately inflated and the pressure of high Z gas in the gap 17 reaches the desired value. All such modifications will be readily understood by those skilled in the art without additional illustrations.

It is not absolutely necessary to place all four marginal portions of the sheet 15 into the clearance 17*a*. For example, it suffices to place the upper and lower or the left-hand and right-hand marginal portions of the sheet (as viewed in FIG. 1) into the clearance 17*a*, as long as the inflated gasket 7 sealingly engages two spaced-apart parallel marginal portions of the sheet.

Once the properly inserted sheet 15 (in the position 15') is sealingly engaged by the gasket 7 (either along two parallel marginal portions or along all four marginal portions), the thus engaged sheet is stabilized to such an extent that the distribution of force lines denoting internal stressing of the sheet in response to admission of compressed high Z gas into the gap 17 (i.e. in response to conversion of sheet 15' into the sheet 15'') is uniform or sufficiently uniform to reduce the likelihood of pronounced distortion of latent image upon evacuation of high Z gas via ports 12, nipple 14, conduit 33, valve 34 and conduits 30, 31. It has been found that, when the gasket 7 is inflated and the pump 25 thereupon supplies compressed high Z gas into the gap 17 via valve 28, conduit 33, nipple 14 and ports 12, the elastic sheet 15 is caused to lie flush against the electrode 5 without any or with negligible formation of folds along the marginal portions. This is attributed to the fact that the stretching of elastic material is distributed practically uniformly along the entire sheet area within the confines of the inflated gasket 7.

The uniformity of expansion or stretching of the sheet 15 (i.e. of conversion of 15′ into 15″) is further enhanced due to conversion of the originally flat sheet into a cylindrical shape (15′) during introduction into the gap 17. Thus, two marginal portions (which are bent during introduction into the gap 17 via channel 22*a*) of the sheet 15 assume a configuration which is identical with or close to the final shape (in response to inflation of the gasket 7) even before the gasket is inflated.

When the exposure of the sheet 15 (in the position 15″) is completed and the valve 34 allows compressed high Z gas to flow from the gap 17 back into the source 27, the pneumatically effected deformation of the central portion of the sheet 15 (within the confines of the still inflated gasket 7) disappears with a minimum of shifting of the sheet. The shifting (contraction) which takes place is distributed practically over the entire area of the sheet within the confines of the gasket 7; this, in turn, insures that the distortion of latent image is much less pronounced than in heretofore known ionography imaging chambers with concentric spherical electrodes. The distortion is observable mainly along the marginal portions of the sheet and is practically non-existent or negligible in a very large central portion of the sheet.

It is presently preferred to introduce the high Z gas in such a way that the sheet 15 in the gap 17 is caused to hug the exposed side of the electrode (5) which is nearer to the source 4 of X-rays. The exposed side of the electrode 5 is convex, i.e. its central portion is closely adjacent to or contacts the central portion of the sheet 15 prior to admission of compressed high Z gas. This further reduces the likelihood of distortion of the central part of the latent image, i.e. of that part which normally constitutes the most important portion of the image. In most instances, pronounced distortion of latent image is observable only at the four corners of a rectangular or square sheet, i.e. in regions which are remotest from the center of the convex exposed side of the electrode 5. By appropriate selection of the material of sheets 15, one can readily insure that the corner portions of the sheet in the gap 17 are not permanently deformed in response to admission of compressed high Z gas via ports 12 in spite of the fact that the deformation of such corner portions is much more pronounced than the deformation of the remaining major part of the sheet. However, even a permanent deformation of corner portions is not fatal to the quality of the latent image because, in most instances, the important parts of the image are located in the central zone, i.e. in the zone wherein the sheet 15 undergoes little deformation or no deformation at all.

The provision of gas-evacuating ports 13 in the section 1 (i.e. in the section for the electrode which determines the shape of the sheet 15 during exposure to object-modulated X-rays) insures that successive sheets can be deformed into concavo-convex bodies with a heretofore unmatched degree of reproducibility. This will be readily understood since the ports 13 permit escape of all traces of high Z gas from the space between the electrode 5 and the adjacent side of the sheet 15 during admission of compressed high Z gas via ports 12. In the absence of ports 13, the sheet 15 would be likely to develop folds, pleats or creases due to entrapment of some high Z gas at the exposed side of the electrode 5.

The configuration of the clearance 17*a* is preferably such that the two longer marginal portions of the sheet 15 in the gap 17 are curved during introduction into the gap. Such longer marginal portions are the upper and lower marginal portions of the sheet 15 shown in FIG. 1. While the distance a can deviate from the width d of the gap 17 between the electrodes 5 and 6, the distance a is necessarily less than the distance b in the case of a rectangular sheet.

The conversion of a flat sheet 15 into a hollow cylinder 15′ during introduction into the gap 17 takes place without any stretching or distortion of the sheet material (as considered in the longitudinal direction of the gap 17), i.e. the force which is needed for such conversion is negligible. However, the shape of the cylindrical sheet (15′) approximates the final (spherical) shape of the sheet (namely, the shape which the sheet assumes in response to admission of compressed high Z gas) much more closely than the shape of a (flat) sheet prior to introduction into the gap 17. Also, the shape of a cylindrical sheet which is bent along its longer sides is closer to the final shape of a gas-deformed sheet than the shape of a cylindrical sheet which is bent along its shorter sides. Therefore, the most unpredictable stage of conversion of a flat sheet into a hollow sphere (namely, the stage which takes place in response to admission of compressed high Z gas into the gap 17) is reduced to a minimum by introducing the sheet 15 in such a way that it is curved along its longer sides. If the sheet were curved along its shorter sides, the distance b would have to equal the width d. If the sheet in the gap 17 (prior to admission of compressed high Z gas) were flat, the width d would equal the distance c. Referring to the aforementioned example ($a=d=8$ mm, $b=12$ mm and $c=20$ mm), the width d of the gap 17 can be reduced from 12 mm to 8 mm by the simple expedient of flexing the introduced sheet (15′) along its longer rather than along its shorter sides.

The just discussed dimensioning of the gap 17 insures that the sheet (15′) need not undergo very pronounced deformation in response to admission of compressed high Z gas via ports 12. This will be readily appreciated by considering that the two longer marginal portions of the sheet (15′) in the interelectrode gap 17 are deformed, practically to the same extent as during the making of a latent image, prior to admission of compressed high Z gas. Moreover, the aforediscussed dimensioning of the gap 17 insures that, when the high Z gas is evacuated from the gap 17 via ports 12, nipple 14 and valve 34, the sheet reassumes the shape 15′ and is not in contact with the electrodes 5 and 6. Therefore, the exposed sheet can be withdrawn without any damage to the latent image thereon.

It is clear that the section 1 can be provided with additional gas-evacuating ports 13, i.e. that the ports 13 need not be provided exclusively at the corners of the gap 17. Furthermore, the corner ports 13 can be replaced by ports machined into the section 1 and communicating with other portions of the gap 17, namely with portions which are remote from the corners. However, the provision of evacuating ports which communicate with the corner portions of the gap 17 is preferred at this time for several reasons. Thus, high Z gases which remain in the gap 17 between the sheet 15 and the electrode 5 are most likely to flow toward the corners in response to admission of compressed high Z gas via ports 12. Secondly, the illustrated evacuating ports 13 are located outside of that (central) part of the sheet 15" which receives the latent image or the important portion of such image. It will be noted that the evacuating ports 13 are close to those marginal portions of the sheet which are curved during introduction of the sheet into the pressure vessel, i.e. adjacent to the arcuate portions of the clearance 17*a*. When the ports 12 admit compressed high Z gas, the deformation of a properly inserted sheet (15') proceeds from the center toward the marginal portions, and the deformation along the curved portions of the clearance 17*a* (whose width is then zero due to inflation of the gasket 7 prior to admission of compressed high Z gas) is completed prior to completion of deformation along the shorter (straight) portions of the clearance. Therefore, gases which have filled the space between the sheet and the electrode 5 prior to start of admission of high Z gas via ports 12 necessarily flow toward the four corners of the gap 17 and are free to escape via ports 13. Otherwise stated, the ports 13 are preferably located close to those portions of the electrode 5 which are last to come in contact with the sheet as a result of deformation of the sheet on admission of high Z gas via ports 12. This insures that the sheet 15 is converted from 15' into 15" without any folding or creasing.

Rapid conversion of the sheet into a concavo-convex body 15" is enhanced by the fact that the pressure of high Z gas in the source 27 (and hence in the ports 13) is at least close to atmospheric pressure and that the ports 12 admit high Z gas at an elevated pressure of at least six atmospheres. The bellows-shaped source 27 expands and contracts in response to evacuation of high Z gas or in response to admission of high Z gas into its interior but invariably prevents any mixing of high Z gas with atmospheric air. As disclosed in the aforementioned copending application Ser. No. 720,577 of Müller et al., separation of air from high Z gas normally necessitates liquefaction of the mixture which is a costly and time-consuming procedure.

Figure 5:
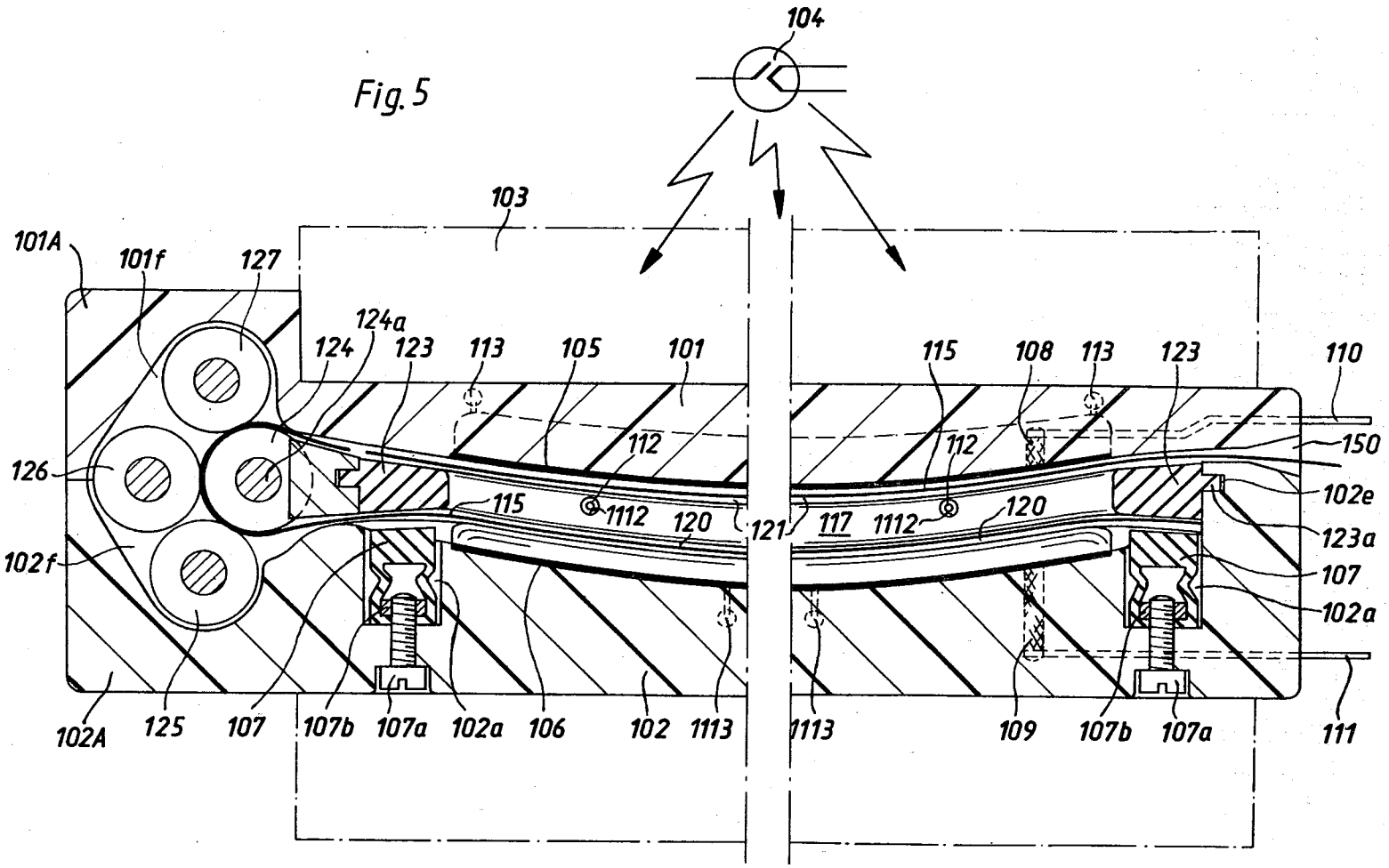
FIG. 5 is a fragmentary sectional view of a modified ionography imaging chamber for simultaneous exposure of two dielectric receptor sheets to object-modulated X-rays.

FIG. 5 shows a portion of a modified ionography imaging chamber wherein all such parts which are identical with or clearly analogous to corresponding parts of the imaging chamber of FIGS. 1 to 4 are denoted by similar reference characters plus 100.

The section 102 of the pressure vessel has arcuate guide slots 120 for the curved marginal portions of a dielectric carrier sheet 115 which is introduced into the gap 117 between the concentric spherical electrodes 105, 106. Similar guide slots 121 are provided in the section 101. The guide slots 120 and 121 receive the respective marginal portions of the carrier sheet 115, or each of these guide slots can receive a discrete sheet. At any rate, the gap 117 receives two sheets which may form portions of a single larger sheet or each of which may constitute a discrete sheet. The centers of curvature of the guide slots 120, 121 are located at the center of the source 104 of X-rays.

The distance between the slots 121 and the electrode 105 at the inner side of the section 101 is selected in such a way that the central portion of the sheet 115 in the slots 121 (such sheet corresponds to the sheet 15' of FIGS. 1 to 3, i.e., it is deformed into the shape of a portion of a hollow cylinder) is barely out of contact with the center of the electrode 105, namely, with that part of this electrode which is the lowest part, as viewed in FIG. 5. Analogously, the distance between the guide slots 120 of the section 102 and the electrode 106 is selected in such a way that the sheet 115 in the slots 120 (such sheet also constitutes a portion of a hollow cylinder) is barely out of contact with the corner portions of the electrode 106 (i.e., with electrode portions which are located at the highest level, as viewed in FIG. 5).

The section 101 has gas-evacuating ports 113 which are located at the corners of the interelectrode gap 117. The section 102 has one, two or more gas-evacuating ports 1113 which are disposed at the center of the electrode 106, i.e., close to that portion of the electrode 106 which is last to come into contact with a deformed sheet 115 in the guide slots 120. Otherwise stated, and as already explained in connection with FIGS. 1 to 4, the evacuating ports 113 and 1113 are in communication with the gap 117 adjacent to those regions of the sheets 115 in the guide slots 121 and 120 which are last to expand into abutment with the respective electrodes 105, 106. Such expansion takes place in response to admission of compressed high Z gas via ports 112 which discharge high Z gas into the space between the sheets 115 in the guide slots 120 and 121, i.e., the high Z gas deforms the upper sheet of FIG. 5 into full face-to-face contact with the convex underside of the electrode 105 and the lower sheet 115 is deformed into full face-to-face contact with the concave upper side of the lower electrode 106. The ports 112 are defined by nipples 1112 which extend through an elastically deformable auxiliary sealing element or gasket 123. The latter has a circumferentially extending external protuberance or bead 123*a* received in a complementary groove 102*e* of the section 102. The auxiliary gasket 123 registers with (i.e., it overlies) the inflatable gasket 107.

The gasket 107 is secured to the section 102 by screws 107*a* whose shanks extend into tapped bores of strips 107*b* in the interior of the gasket 107. When the screws 107*a* are tightened, the strips 107*b* are urged downwardly, as viewed in FIG. 5, and cause the elastic material of the gasket 107 to sealingly surround the shanks of the screws 107*a*.

If the sheets 115 in the guide slots 120 and 121 form parts of a single (doubled) sheet, the trailing portion of the single sheet is received in the clearance between the gasket 123 and the adjacent portion of the section 101, and the leader of the single sheet is received in the clearance between the gaskets 107, 123 at the right-hand side of FIG. 5. When the gasket 107 is inflated, the leader of the single sheet is sealingly clamped between the gaskets 107, 123 and the trailing portion of the single sheet is sealingly clamped between the gasket 123 and the section 101. The bead 123*a* is held in the groove 102*e* so that the gasket 123 remains in register with the gasket 107 when the latter is inflated in response to admission of a gas, e.g., a buffer gas, in a manner analogous to that described in connection with FIG. 4.

A single sheet 115 which is introduced into the pressure vessel via inlet 150 is caused to move two of its marginal portions into and along the guide slots 121 of the section 101 and the leader of the sheet thereupon travels about a direction changing rotary member or roller 124 which is installed in extensions 101A and 102A of the sections 101 and 102. The diameter of the direction changing roller 124 is such that the left-hand portions of the guide slots 120, 121 are tangential to its peripheral surface. This roller is mounted in communicating compartments 101*f*, 102*f* of the extensions 101A, 102A. The extensions 101A, 102A further contain three pressure rolls 125, 126, 127 which are spaced apart from each other, as considered in the circumferential direction of the roller 124, and serve to direct the leader of the sheet 115 into the left-hand portions of the guide slots 120 in the section 102. The pressure rolls 125, 126, 127 preferably consist of or comprise peripheral layers of elstomeric material which contacts the sheet 115 in the compartments 101*f*, 102*f*.

The imaging chamber of FIG. 5 preferably further comprises means for rotating at least one of the rotary members 124–127 (for example, the shaft 124*a* of the direction changing roller 124 may be driven by a handle or by a motor, not shown) so that the leader of a sheet 115 which has been introduced into the guide slots 121 automatically enters into and advances along the guide slots 120 when the roller 124 is rotated by the shaft 124*a*.

When the sheet 115 is properly introduced into the gap 117 in a manner as shown in FIG. 5, the gasket 107 is inflated to seal the gap from the atmosphere, and the ports 112 admit compressed high Z gas. One of the halves of the sheet 115 in the gap 117 then receives a positive and the other half of the sheet receives a negative latent image of the object which is interposed between the source 104 and the section 101 of the pressure vessel. Thus, the chamber of FIG. 5 can furnish two latent images without increasing the dosage of X-rays and without prolonging the exposing step. The latent images are thereupon developed and fixed in any suitable way, e.g., by resorting to toner particles.

In order to evacuate an exposed sheet 115 from the gap 117, the direction of rotation of the shaft 124*a* is reversed so that the sheet is expelled via inlet 150, i.e., the leader of the exposed sheet becomes the trailing end and passes first through the slots 120, thereupon around the direction changing roller 124 and finally through the slots 121 on its way toward 150.

The development of both latent images on the sheet 115 need not be preceded by a severing or flexing of the sheet because, as soon as the sheet is withdrawn, both images are located at one and the same side thereof. The inlet 150 can communicate with the channel of a gate corresponding to the gate 22 of FIG. 4.

It is clear that the imaging chamber of FIG. 5 can be used with equal advantage for the making of a single (positive or negative) latent image at a time. Thus, if a sheet is introduced into the slots 120 (i.e., beyond the slots 121), the exposure of such sheet to object-modulated X-rays will result in one type of latent image. Another type of latent image will be obtained if the sheet is introduced into the slots 121 but does not extend into the slots 120. The sheets which are used for the making of single (positive or negative) images need not be as long as the sheet 115 of FIG. 5. Furthermore, it is equally possible to introduce two discrete sheets, one after the other, so that the front sheet is adjacent to the electrode 106 and the rear sheet is adjacent to the electrode 105. Such sheets are deformed into full face-to-face contact with the respective electrodes in response to admission of compressed high Z gas via ports 112.

If the gap 117 contains two sheets or two portions of a single sheet 115 which is trained over the direction changing roller 124, negative ions are collected by the sheet or sheet portion adhering to the front electrode 105 and positive ions are collected by the rear electrode 106. All that is necessary is to apply a suitable biasing potential. If one of the thus obtained latent images is developed in accordance with the so-called "edge effect", a single exposure (without any increase in the exposure of the object to X-rays) results in the making of two images which is often desirable for diagnostic purposes.

The auxiliary gasket 123 may but need not be inflatable.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In a method of exposing elastic dielectric receptor sheets in the gap between concentric first and second spherical electrodes of an ionography imaging chamber to object-modulated X-rays which issue from a source located nearer to one of the electrodes, the steps of maintaining said electrodes at a fixed distance from each other so that the width of said gap is constant at all times; introducing into the gap at least one receptor sheet; biasing at least a part of the margin of the introduced sheet against the adjacent portion of the imaging chamber; and thereupon admitting into the gap compressed high Z gas at one side of the introduced sheet at a pressure which suffices to deform the sheet in the gap and to maintain the deformed sheet in face-to-face contact with the first electrode while said part of the margin of the sheet is biased against said portion of the imaging chamber.

2. In a method as defined in claim 1, the additional step of converting the sheet into a portion of a hollow cylinder not later than in the course of said introducing step, the center of curvature of said cylinder being located at said source.

3. In a method as defined in claim 1, wherein said sheet is a polygonal sheet and said margin thereof includes at least one pair of spaced parallel marginal portions, said part of the margin including said parallel marginal portions.

4. In a method as defined in claim 1, wherein said biasing step includes clamping said part of the margin of the sheet between said portion of the imaging chamber and an inflatable gasket.

5. In a method as defined in claim 1, wherein said first electrode is said one electrode.

6. In a method as defined in claim 1, the additional step of providing a path for the escape of gases from between the other side of the introduced sheet and the first electrode during admission of compressed high Z gas.

7. In a method as defined in claim 1, wherein said first mentioned step includes introducing into the gap two dielectric receptor sheets, said last mentioned step including admitting compressed high Z gas between the sheets in said gap so that one of the sheets is deformed against said first and the other of the sheets is deformed against said second electrode.

8. In a method as defined in claim 7, the additional step of providing paths for the evacuation of gases from between said one sheet and the first electrode and from between said other sheet and the second electrode during admission of compressed high Z gas between the sheets in said gap.

9. In a method as defined in claim 7, wherein said sheets constitute overlapping portions of a single sheet.

10. In a method as defined in claim 1, wherein the pressure of high Z gas in the gap is in the range of several atmospheres above atmospheric pressure.

11. An ionography imaging chamber for exposure of elastic dielectric receptor sheets to object-modulated X-rays issuing from a source, comprising a pressure vessel having first and second sections; first and second spherical electrodes attached to the respective sections and defining an interelectrode gap for receptor sheets, said electrodes being located at a fixed distance from each other and being centered at the source of X-rays; sealing means disposed between said sections, surrounding said gap and defining with said vessel a clearnace for introduction and withdrawal of receptor sheets from said gap, said sealing means being inflatable to thereby seal said gap from the surrounding atmosphere and to clamp at least a part of the margin of an introduced sheet in said clearance against movement relative to said vessel; a source of high Z gas; and means for admitting high Z gas from said last mentioned source between one side of a sheet in said gap and one of said electrodes at a pressure which suffices to deform the sheet and to thus maintain the deformed sheet in face-to-face contact with the other of said electrodes.

12. A chamber as defined in claim 11, wherein said clearance includes spaced apart arcuate portions whose centers of curvature are located at said first mentioned source and which convert an originally flat sheet into a portion of a hollow cylinder during introduction into said gap.

13. A chamber as defined in claim 12, wherein said other electrode is nearer to said first mentioned source than said one electrode, said arcuate portions of said clearance being adjacent said other electrode.

14. A chamber as defined in claim 13, wherein said other electrode has a rectangular shape and said arcuate portions of said clearance extend along the longer sides of said other electrode.

15. A chamber as defined in claim 14, wherein the width of said gap substantially equals the distance between the shorter sides of said other electrode and said one electrode.

16. A chamber as defined in claim 11, wherein said gap has a polygonal outline and the section carrying said other electrode has gas-evacuating ports communicating with the corners of said gap.

17. A chamber as defined in claim 16, wherein said ports are adjacent said clearance and are located outside of that area of a sheet in said gap which is allocated for exposure of a latent image.

18. A chamber as defined in claim 11, wherein said gas admitting means includes means for compressing the high Z gas to a pressure of at least six atmospheres.

19. A chamber as defined in claim 18, wherein said last mentioned source includes means for maintaining the high Z gas at a pressure approximating atmospheric pressure, the section which carries said other electrode having gas-evacuating ports communicating with said gap and with said last mentioned source.

20. A chamber as defined in claim 19, wherein said last mentioned source is a bellows.

21. A chamber as defined in claim 11, further comprising means for inflating said sealing means and means for controlling the operation of said inflating means to precede the operation of said gas admitting means.

22. A chamber as defined in claim 21, wherein said controlling means comprises a timer.

23. A chamber as defined in claim 21, wherein said controlling means comprises pressure responsive switch means.

24. A chamber as defined in claim 11, wherein said clearance has a portion which defines a path for introduction of carrier sheets into and for withdrawal of carrier sheets from said gap, and further comprising a gate having a channel in communication with said portion of said clearance, a source of buffer gas which is readily separable from said high Z gas, and means for admitting buffer gas from the respective source into said channel.

25. A chamber as defined in claim 24, further comprising means for connecting said source of buffer gas with said inflatable sealing means.

26. A chamber as defined in claim 24, wherein said buffer gas is $CO_2$ gas.

27. A chamber as defined in claim 11, wherein each of said sections has guide means adjacent the respective electrode and each of said guide means is arranged to receive portions of the margin of a receptor sheet, said admitting means including at least one port provided in said vessel for admission of compressed high Z gas between the sheets in said gap.

28. A chamber as defined in claim 27, wherein said guide means include arcuate slots having centers of curvature at said source of X-rays.

29. A chamber as defined in claim 27, further comprising means for changing the direction of movement of sheets which are introduced into said gap by way of one of said guide means so that such sheets thereupon enter and advance along the other of said guide means.

30. A chamber as defined in claim 29, wherein said guide means include slots and said direction changing means comprises a rotary member, said slots having portions which are substantially tangential to the periphery of said rotary member.

31. A chamber as defined in claim 30, further comprising pressure rolls provided in said vessel to bias a sheet against the periphery of said rotary member during travel of such sheet about said rotary member.

32. A chamber as defined in claim 27, wherein said sealing means includes an inflatable gasket and a second gasket overlying said inflatable gasket, one of said guide means having a portion disposed between said second gasket and one of said sections and the other of said guide means having a portion disposed between said gaskets.

* * * * *